US007102470B2

(12) United States Patent
Chang et al.

(10) Patent No.: US 7,102,470 B2
(45) Date of Patent: Sep. 5, 2006

(54) DUAL-BAND BANDPASS FILTER WITH STEPPED-IMPEDANCE RESONATORS

(75) Inventors: Sheng-Fuh Chang, Ming-Hsiun (TW); Shuen-Chien Chang, Ming-Hsiun (TW); Jia-Liang Chen, Ming-Hsiun (TW); Shih-Chieh Chen, Ming-Hsiun (TW); Hung-Cheng Chen, Hsinchu (TW); Shu-Fen Tang, Hsinchu (TW); Albert Chen, Hsinchu (TW)

(73) Assignees: Integrated System Solution Corp., Hsin-Chu (TW); Sheng-Fuh Chang, Chia-Yi (TW)

( * ) Notice: Subject to any disclaimer, the term of this patent is extended or adjusted under 35 U.S.C. 154(b) by 0 days.

(21) Appl. No.: 10/978,395

(22) Filed: Nov. 2, 2004

(65) Prior Publication Data

US 2006/0091979 A1 May 4, 2006

(51) Int. Cl.
*H01P 1/203* (2006.01)

(52) U.S. Cl. ..... 333/204; 333/219

(58) Field of Classification Search ..... 333/203, 333/204, 205, 219, 246
See application file for complete search history.

(56) References Cited

U.S. PATENT DOCUMENTS 4,701,727 A * 10/1987 Wong ..... 333/204
4,799,034 A * 1/1989 Silverman et al. ..... 333/202
5,055,809 A * 10/1991 Sagawa et al. ..... 333/219
5,608,364 A * 3/1997 Hirai et al. ..... 333/204
5,990,765 A * 11/1999 Mansour et al. ..... 333/204

OTHER PUBLICATIONS

Sagawa et al., "Geometrical Structures and Fundamental Characteristics of Microwave Stepped-Impedance Resonators", IEEE trans. on Microwave Theory & Techniques, vol. 45, No. 7, Jul. 1997, pp. 1078-1085.*
Avrillon et al., "Dual-Band Power Divider Based on Semiloop Stepped-Impedance Resonators", IEEE trans. on Microwave Theory & Techniques, vol. 51, No. 4, Apr. 2003, pp. 1269-1273.*
Makimoto et al., "Bandpass Filters Using parallel Coupled Stripline Stepped Impedance Resoantors", IEEE trans. on Microwave Theory & Techniques, vol. MTT-28, No. 12, Dec. 1980, pp. 1413-1417.*
Apriyana et al., "A Dual-band BPF for Concurrent Dual-band Wireless Transceiver", Electronic Pakaging Technology, 2003 5th Conference, Dec. 10-12, 2003, pp. 145-149.*
Hideyuki Miyake et al., "A miniaturized monolitic dual band filter using ceramic lamination technique for dual mode portable telephones", 1997 IEEE MTT-S Int. Microwave Symp. Dig., vol. 2, pp. 789-792.
Sheng-Fuh Chang et al., "Dual -band step-impedance bandpass filter for multimode wireless LANs", Electronic Letters, Jan. 8, 2004, vol. 40, No. 1.

* cited by examiner

*Primary Examiner*—Seungsook Ham
(74) *Attorney, Agent, or Firm*—Birch, Stewart, Kolasch & Birch, LLP

(57) ABSTRACT

A dual-band bandpass filter with stepped-impedance resonators uses only one circuit to generate dual-band effect. It adopts the principle of stepped-impedance resonator, which contains a connecting section and two coupling sections. The impedance and electrical length of the connecting section and coupling sections conforms to a selected condition to generate two passbands at desired frequencies. A multi-layer broadside-coupled parallel lines structure may be applied to increase coupling-amount between the parallel lines so that the dual-band bandpass filters have broader bandwidth and less loss.

21 Claims, 7 Drawing Sheets

DUAL-BAND BANDPASS FILTER WITH STEPPED-IMPEDANCE RESONATORS

FIELD OF THE INVENTION

The present invention relates to a dual-band bandpass filter adopted for use in wireless communication and particularly to a dual-band bandpass filter with stepped-impedance resonators.

BACKGROUND OF THE INVENTION

Wireless communication has had a tremendous growth in recent years. Developments of wireless transceivers have been gradually directed to multiple bandwidths to provide more flexibility. By means of this technology, users can access different services through one multi-mode, multi-band terminal. In the previous technology, GSM and WCDMA communication systems achieve the dual-band operation by switching two separated transceivers. Such architecture requires two transceivers operating in different frequency. Hence, it requires higher cost, greater circuit area, and more power consumption. To overcome these drawbacks, a so-called concurrent dual-band architecture has been introduced. In this architecture, one transceiver can simultaneously operate in two passbands, where the key building blocks, such as low noise amplifier and bandpass filter, have two concurrent passbands and adequate the stop-band suppression. The concurrent dual-band low noise amplifier has been designed to achieve the required effect, but the dual-band bandpass filter is still not yet reported H. Miyake, S. Kitazawa, T. Ishizaki, T. Yamada, and Y. Nagatomi, "A miniaturized monolithic dual band filter using ceramic lamination technique for dual mode portable telephones," 1997 IEEE MTT-S Int. Microwave Symp. Dig., vol. 2, pp. 789–792, June 1997, a dual-band bandpass filter was fabricated in low temperature co-fired ceramic processes. However, its structure actually included two separated filters. The filter layout at the upper four layers was designed for the pass-band of 900 MHz and layout at the lower four layers was for the pass-band of 1800 MHz. Although these two circuits were fabricated at the same low temperature co-fired ceramic chip, they had individual output and input ports, hence required additional input and output combination circuits to transmit the signal through a single pair of input and output ports. In practice, it still does not effectively reduce the circuit area and cost.

SUMMARY OF THE INVENTION

To resolve the foregoing problems, a dual-band bandpass filter with stepped-impedance resonators was provided and it requires only one circuit to generate a concurrent dual-passband effect.

The dual-band bandpass filter with stepped-impedance resonators according to the invention includes a circuit board, input end, output end and at least two stepped-impedance resonators. The input end, output end and resonators are mounted onto the circuit board. The input end receives signals and the output end output signals respectively. Each resonator includes a connecting section which had two ends connected respectively to a coupling section.

Moreover, the coupling sections of the resonators are coupled with each other. One coupling section is coupled respectively with the input end and the output end to filter input signals. Also, the multi-layer broadside-coupled parallel lines structure can be applied to implement dual-band filters with broader bandwidth and less loss.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1A:
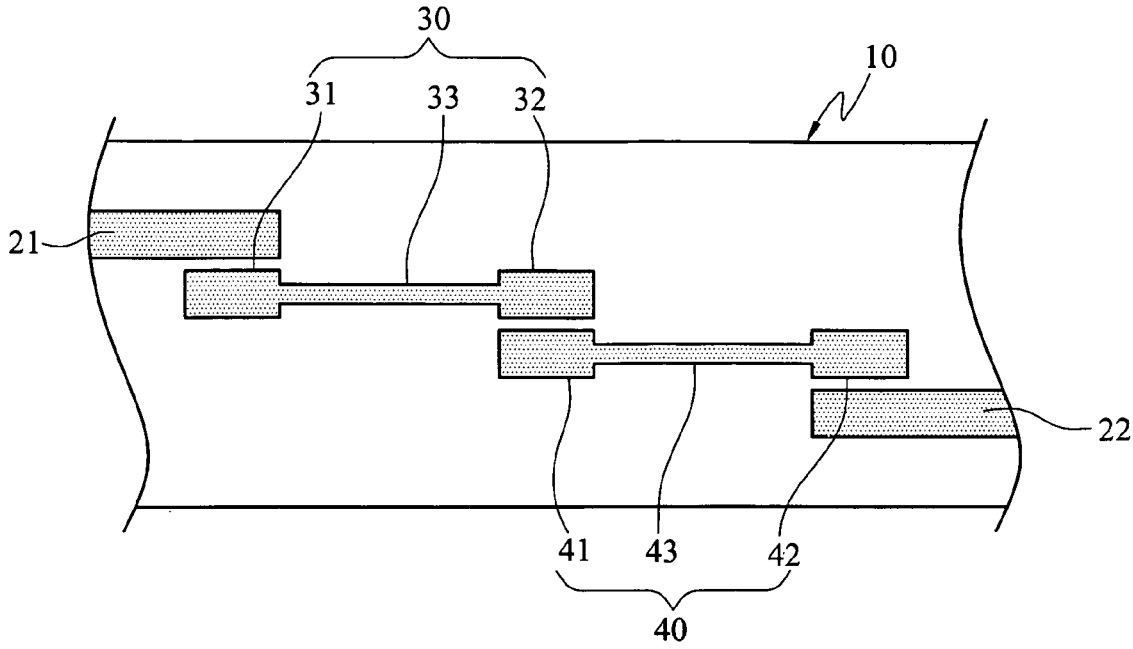
FIGS. 1A and 1B are schematic diagrams of the invention.

Referring to FIG. 1A, the dual-band bandpass filter equipped with stepped-impedance resonators according to the invention includes a circuit board 10, an input end 21, an output end 22, a first resonator 30 and a second resonator 40. The input end 21, the output end 22, the first resonator 30 and the second resonator 40 are mounted onto the circuit board 10. The input end 21 receives signals to be filtered. After the signals have been filtered, they are transmitted outwards through the output end 22.

The first resonator 30 has a first coupling section 31 coupling with the input end 21 and a second coupling section 32 coupling with a third coupling section 41 of the second resonator 40. The second resonator 40 has a fourth coupling section 42 coupling with the output end 22. Hence signals received from the input end 21 are transmitted outwards through the output end 22 through the coupling relationships set forth above. Meanwhile, each of the coupling sections can be in a broadside-coupled structure to increase the coupling. The first resonator 30 and the second resonator 40 have the same structure. The first resonator 30 is used as an example below for more details.

Figure 1B:
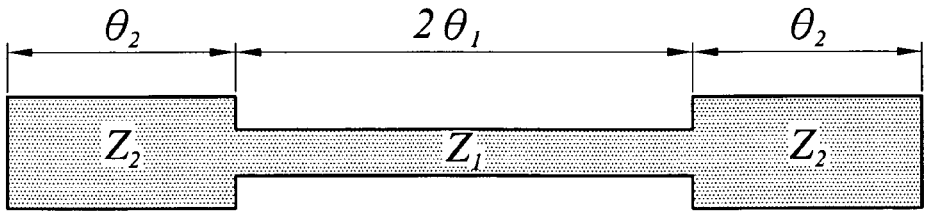

The first resonator 30 includes two symmetrical coupling sections 31 and 32 at two ends, and a connecting section 33 to bridge the two coupling sections. They are all transverse electromagnetic wave (TEM) or quasi-TEM transmission lines. Referring to FIG. 1B, define the impedance ratio of the transmission line is: $Z_2/Z_1=R$ and total electric length is: $\theta_T=2(\theta_1+\theta_2)$ By means of the even-mode and odd-mode analysis method, the odd resonance condition at first resonance frequency $f_1$ is as follows:

$$\theta_T = 2\tan^{-1}\left[\frac{1}{1-R}\left(\frac{R}{\tan\theta_1}+\tan\theta_1\right)\right] \tag{1}$$

$$\theta_1 = \tan^{-1}\left(\sqrt{R}\right) \tag{2}$$

The even resonance condition at second resonance frequency $f_2$ is as follows:

$$\tan\theta_1 = \infty \quad \theta_1 = \frac{n}{2}\pi,\ n = 1, 2, 3\ldots \tag{3}$$

Figure 2A:
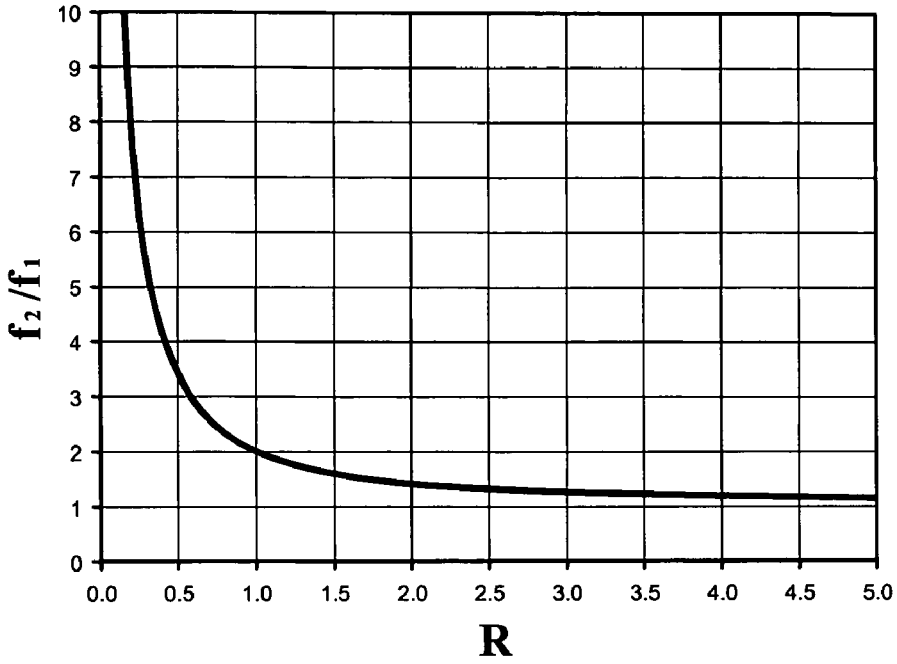
FIG. 2A is a chart showing the relationship between impendence ratio and first two resonant frequencies of the resonator according to the invention.
Figure 2B:
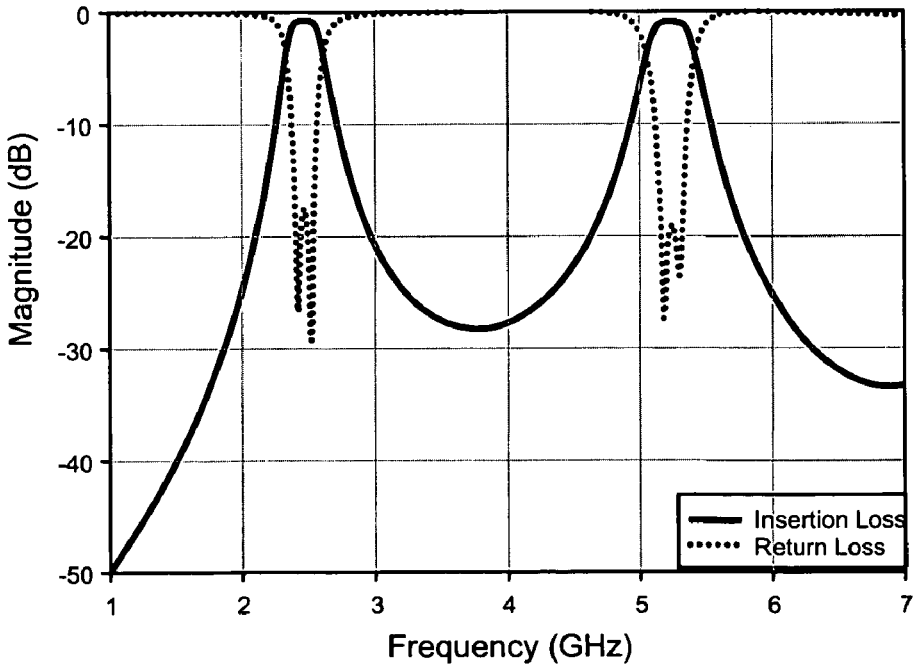
FIG. 2B is a chart showing a full-wave simulation result of the filter of the invention.

When $\theta_1=\theta_2$, the relationship of the ratio of first resonance frequency and the second resonance frequency and the impendence ratio R can be further derived as below:

$$\frac{f_2}{f_1} = \frac{\theta_{1S}}{\theta_1} = \frac{\pi}{2\tan^{-1}\sqrt{R}} \tag{4}$$

$$\Rightarrow R = \left(\tan\frac{\pi f_1}{2f_2}\right)^2 \tag{5}$$

where $f_2$ is the second resonance frequency of the resonator, and $f_1$ is the first resonance frequency. Hence altering the value of R may control the frequencies of two passbands, and the required dual passbands may be achieved (referring to FIG. 2A). Take the dual-band bandpass filter used in the wireless local area network (WLAN) of 2.4/5.2 GHz for example:

$$\frac{f_2}{f_1} = \frac{5.2}{2.4} = \frac{\pi}{2\tan^{-1}\sqrt{R}}$$

$$\text{hence } R = 0.785.$$

When $\theta_1=\frac{1}{2}\theta_2$, the relationship of the ratio of first resonance frequency and the second resonance frequency and R may be indicated as follow:

$$\frac{f_2}{f_1} = \frac{\tan^{-1}\sqrt{\frac{R+2}{R}}}{\tan^{-1}\sqrt{\frac{R}{R+2}}}$$

Figure 3:
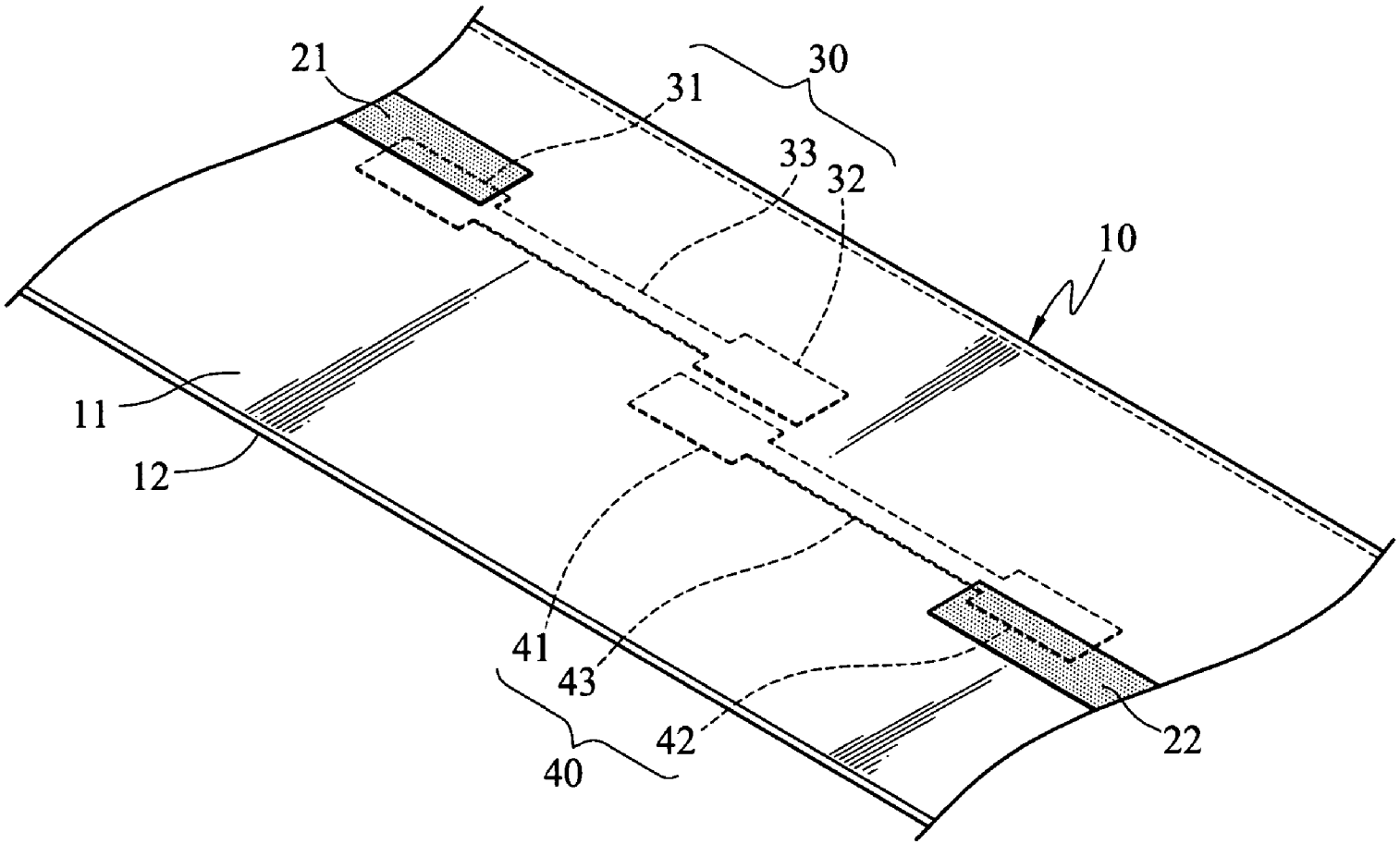
FIG. 3 is a schematic diagrams of the invention adopted on a two-layer circuit board.

When the circuit is complemented with a two-layer circuit board 10, there is a first layer 11 and a second layer 12 (referring to FIG. 3). The input end 21 and output end 22 are located on the first layer 11, while the first resonator 30 and the second resonator 40 are located on the second layer 12. The coupling relationship is still maintained. The difference between structures in FIG. 3 and FIG. 1 is that the input end 21 is coupled with the first coupling section 31 of the first resonator 30 through the circuit board 10, and the fourth coupling section 42 of the second resonator 40 is coupled with the output end 22 through the circuit board 10. As seen from the top view, the input end 21 and the first coupling section 31, the output end 22 and the fourth coupling section 42 alike, can be fully overlapped to reduce insertion loss.

Figure 4A:
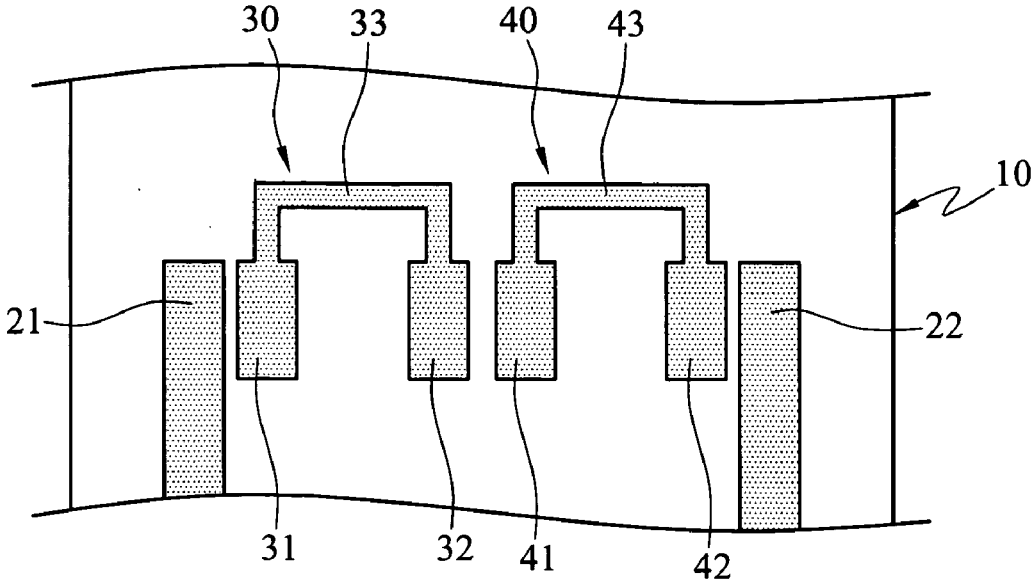
FIGS. 4A, 4B and 4C are schematic diagrams of a second embodiment of the resonator of the invention.
Figure 4B:
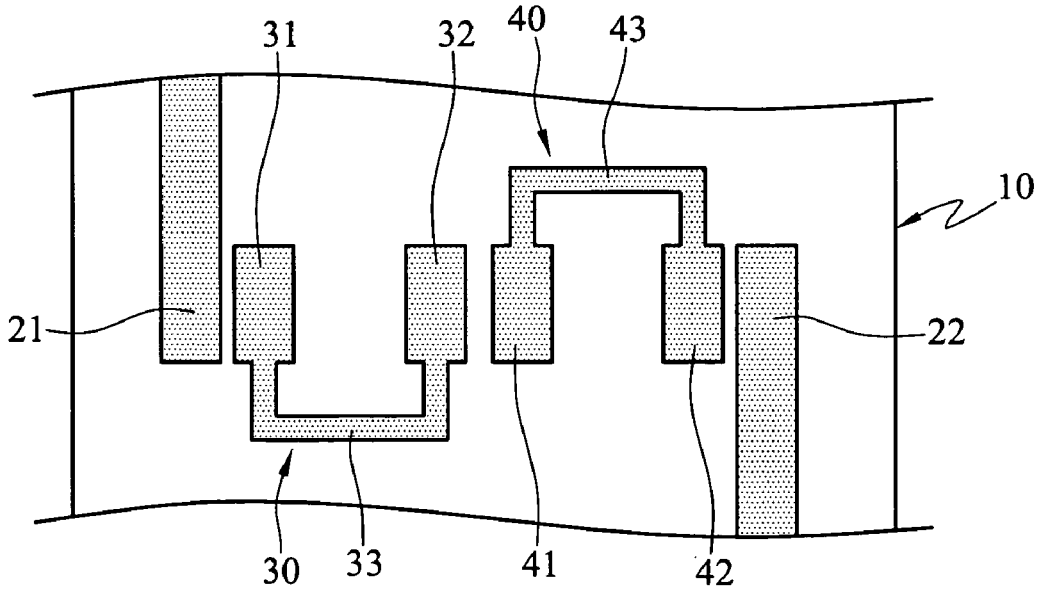
Figure 4C:
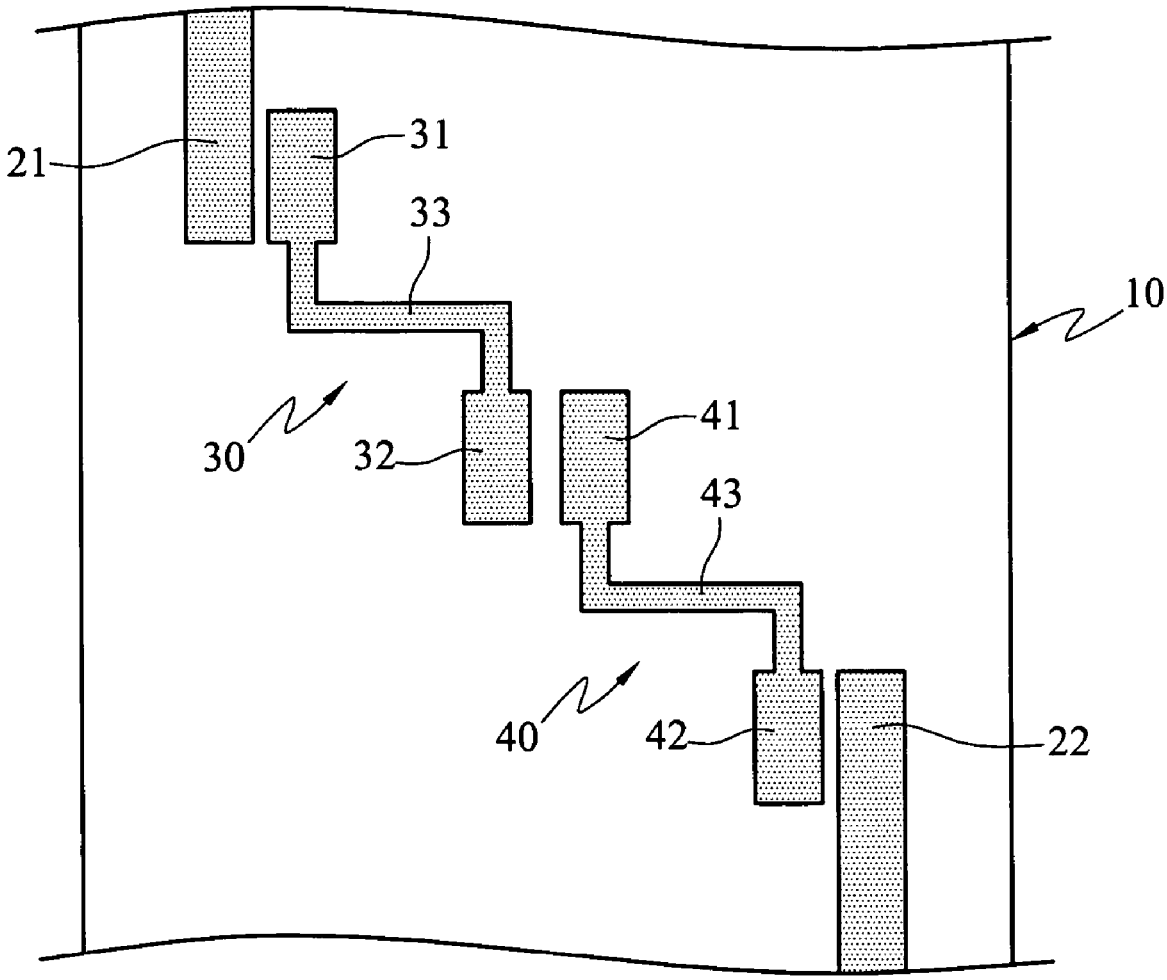
Figure 5A:
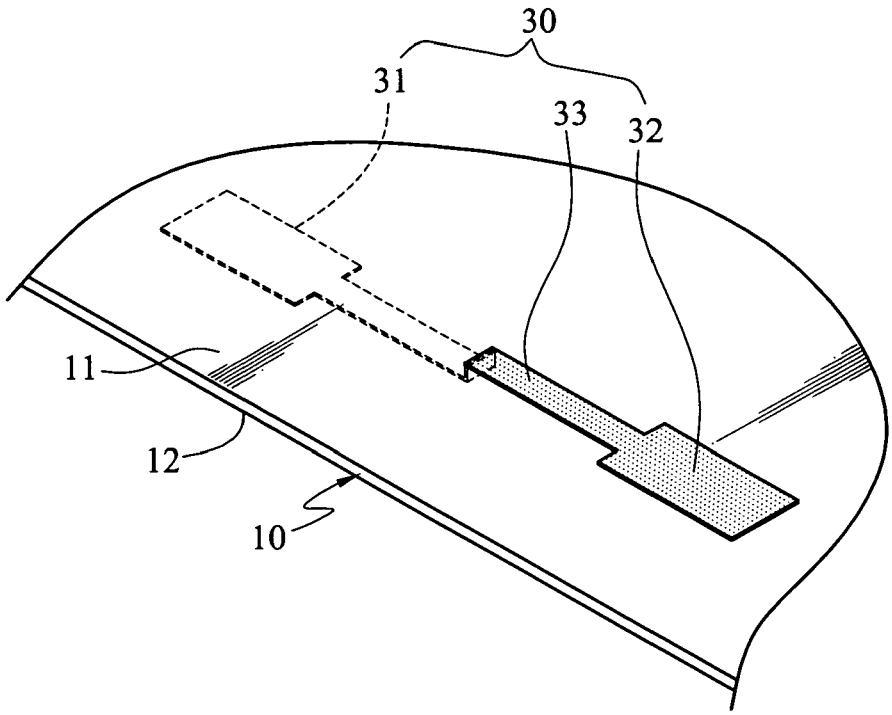
FIGS. 5A and 5B are schematic views of a third embodiment of the resonator of the invention.
Figure 5B:
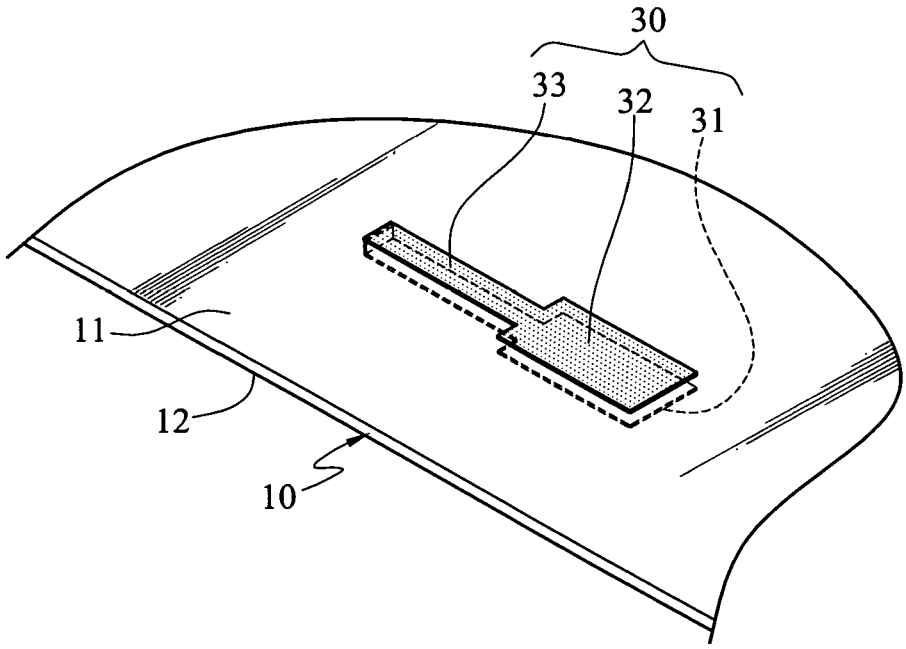

Besides the example set forth above where the connecting section 33 of the first resonator 30 is collinear with the coupling sections 31 and 32, a design of U-shaped resonator may also be formed as shown in a second embodiment in FIGS. 4A, 4B and 4C. Namely, the connecting section 33 is bent and located on one side of the coupling sections 31 and 32. The first resonator 30 and the second resonator 40 are coupled together in the same orientation (referring to FIG. 4A), or in the opposite orientation (as shown in FIG. 4B). Furthermore, the coupling sections 31 and 32 can be also located respectively on opposite sides of the connecting section (as shown in FIG. 4C). Refer to FIGS. 5A and 5B for a third embodiment of the invention. The first coupling section 31 of the first resonator 30 is located on a first layer 11 and connecting section 33 located on both the layer 11 and the layer 12, the second coupling section 32 is located on the second layer 12 of the circuit board 10, and the coupling sections 31 and 32 are unoverlapped (referring to FIG. 5A) or overlapped—(referring to FIG. 5B).

Figure 6:
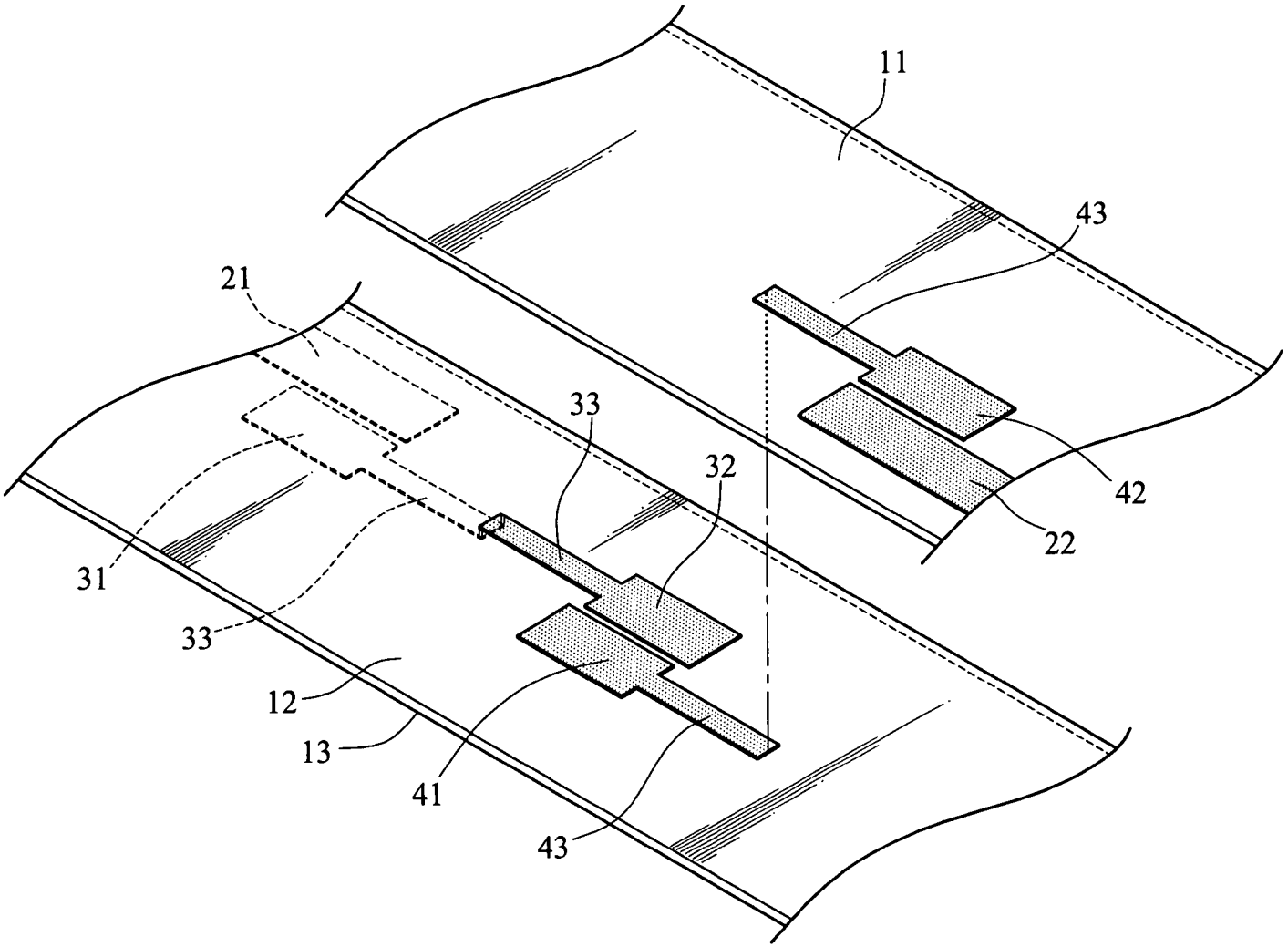
FIG. 6 is a schematic view of the invention adopted on a multi-layer circuit board.

The invention can be adopted on a multi-layer circuit board 10 as shown in third embodiment in FIG. 6 (also referring to FIGS. 5A and 5B). The input end 21 is coupled with the first coupling section 31 of the first resonator 30 on a third layer 13, the second coupling section 32 of the first resonator 30 is coupled with the third coupling section 41 of the second resonator 40 on a second layer 12, and the fourth coupling section 42 of the second resonator 40 is coupled with the output end 22 on a first layer 11.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. A dual-band bandpass filter equipped with stepped-impedance resonators for filtering a signal, comprising:

a circuit board;

an input end located on the circuit board for receiving the signal;

an output end located on the circuit board to transmit the filtered signal; and at least two resonators located on the circuit board, each of the resonators including a connecting section and two coupling sections; the connecting section connecting two coupling sections; one coupling section of the first resonator being coupled with one coupling section of the second resonator and the other coupling section of the first resonator being coupled with the input end or the output end;

wherein the circuit board is a multi-layer circuit board, including at least a first layer, a second layer and a third layer, the resonators being located at least on the second layer, the input end and the output end being located respectively on the first layer and the third layer;

wherein an impedance of the connecting section and the coupling sections satisfies the condition:

$$R = \left(\tan\frac{\pi f_1}{2f_2}\right)^2,$$

wherein $f_1$ is a first resonance frequency of the resonator, and $f_2$ is the second resonance frequency of the resonator and wherein each of the connecting sections of the two resonators is located on two of the layers of the circuit board such that the coupling sections of the two resonators are located on two opposite sides of the circuit board.

2. The dual-band bandpass filter equipped with stepped-impedance resonators of claim 1, wherein the impedance of the connecting section and the coupling section is controllable by adjusting the width and length of the coupling sections and the connecting section.

3. The dual-band bandpass filter equipped with stepped-impedance resonators of claim 1, wherein the coupling sections are connected to the two ends of the connecting section in a symmetrical fashion.

4. The dual-band bandpass filter equipped with stepped-impedance resonators of claim 1, wherein the coupling sections and the connecting section are transverse electromagnetic (TEM) or quasi-TEM transmission lines.

5. The dual-band bandpass filter equipped with stepped-impedance resonators of claim 4, wherein the coupling sections have respectively a long shaft in parallel with a long shaft of the connecting section.

6. The dual-band bandpass filter equipped with stepped-impedance resonators of claim 4, wherein the coupling sections have respectively a long shaft in normal to a long shaft of the connecting section.

7. The dual-band bandpass filter equipped with stepped-impedance resonators of claim 6, wherein the two coupling sections are located on the same side of the connecting section.

8. The dual-band bandpass filter equipped with stepped-impedance resonators of claim 6, wherein the two coupling sections are located on two opposite sides of the connecting section.

9. The dual-band bandpass filter equipped with stepped-impedance resonators of claim 1, wherein the resonators, and the input end and the output end are located on opposite sides to the circuit board.

10. The dual-band bandpass filter equipped with stepped-impedance resonators of claim 1, wherein the coupling sections are broadside-coupled or co-plane coupled.

11. A dual-band bandpass filter equipped with stepped-impedance resonators for filtering a signal, comprising:

a circuit board;

an input end located on the circuit board for receiving the signal;

an output end located on the circuit board to transmit the filtered signal; and at least two resonators located on the circuit board, each of the resonators including a connecting section and two coupling sections; the connecting section connecting two-coupling sections; one coupling section of the first resonator being coupled with one coupling section of the second resonator and the other coupling section of the first resonator being coupled with the input end or the output end;

wherein the circuit board is a multi-layer circuit board including at least a first layer, a second layer and a third layer, one of the two resonators being coupled with the input end on the first layer and being crossed over to the second layer to couple with another resonator, the other resonator being crossed over to the third layer to couple with the output end;

wherein an impedance of the connecting section and the coupling section satisfies the condition:

$$R = \left(\tan\frac{\pi f_1}{2f_2}\right)^2,$$

wherein $f_1$ is a first resonance frequency of the resonator, and $f_2$ is the second resonance frequency of the resonator.

12. The dual-band bandpass filter equipped with stepped-impedance resonators of claim 11, wherein the impedance of the connecting section and the coupling section is controllable by adjusting the width and length of the coupling sections and the connecting section.

13. The dual-band bandpass filter equipped with stepped-impedance resonators of claim 11, wherein the coupling sections are connected to the two ends of the connecting section in a symmetrical fashion.

14. The dual-band bandpass filter equipped with stepped-impedance resonators of claim 11, wherein the coupling sections and the connecting section are transverse electromagnetic (TEM) or quasi-TEM transmission lines.

15. The dual-band bandpass filter equipped with stepped-impedance resonators of claim 14, wherein the coupling sections have respectively a long shaft in parallel with a long shaft of the connecting section.

16. The dual-band bandpass filter equipped with stepped-impedance resonators of claim 14, wherein the coupling sections have respectively a long shaft in normal to a long shaft of the connecting section.

17. The dual-band bandpass filter equipped with stepped-impedance resonators of claim 16, wherein the two coupling sections are located on the same side of the connecting section.

18. The dual-band bandpass filter equipped with stepped-impedance resonators of claim 16, wherein the two coupling sections are located on two opposite sides of the connecting section.

19. The dual-band bandpass filter equipped with stepped-impedance resonators of claim 11, wherein the resonators, and the input end and the output end are located on opposite sides to the circuit board.

20. The dual-band bandpass filter equipped with stepped-impedance resonators of claim 11, wherein each of the connecting sections of the two resonators is located on two sides of the circuit board such that the coupling sections of the two resonators are located on two opposite sides of the circuit board.

21. The dual-band bandpass filter equipped with stepped-impedance resonators of claim 11, wherein the coupling sections are broadside-coupled or co-plane coupled.

* * * * *